US010369824B2

(12) United States Patent
Takei

(10) Patent No.: US 10,369,824 B2
(45) Date of Patent: Aug. 6, 2019

(54) TRANSPORT APPARATUS AND PRINTING APPARATUS

(71) Applicant: SEIKO EPSON CORPORATION, Tokyo (JP)

(72) Inventor: Hiroaki Takei, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/988,925

(22) Filed: May 24, 2018

(65) Prior Publication Data

US 2018/0339534 A1 Nov. 29, 2018

(30) Foreign Application Priority Data

May 26, 2017 (JP) ..... 2017-104641

(51) Int. Cl.
*B41J 29/02* (2006.01)
*B65H 5/06* (2006.01)
*B41J 13/02* (2006.01)

(52) U.S. Cl.
CPC ..... *B41J 29/023* (2013.01); *B41J 13/025* (2013.01); *B41J 29/02* (2013.01); *B65H 5/062* (2013.01); *B65H 2402/542* (2013.01); *B65H 2404/143* (2013.01); *B65H 2404/144* (2013.01); *B65H 2404/1521* (2013.01); *B65H 2601/24* (2013.01)

(58) Field of Classification Search
CPC ..... B41J 29/023; B41J 29/02; B41J 13/025; B65H 2404/144; B65H 2404/1521; B65H 2404/143
See application file for complete search history.

(56) References Cited

U.S. PATENT DOCUMENTS 6,719,286 B1 * 4/2004 Ohyama ..... B65H 29/12 271/119
7,114,805 B2 * 10/2006 Niikura ..... B41J 29/02 347/108
7,222,955 B2 * 5/2007 Ohashi ..... B41J 3/60 271/186
7,607,663 B2 * 10/2009 Sugiyama ..... B41J 13/025 271/274

(Continued)

FOREIGN PATENT DOCUMENTS

JP 2000-158741 A 6/2000
JP 2000-158742 A 6/2000

(Continued)

*Primary Examiner* — Patrick Cicchino
(74) *Attorney, Agent, or Firm* — Workman Nydegger

(57) ABSTRACT

A transport apparatus includes an idler roller and a drive roller that transport a medium by rotating with the medium being nipped therebetween, a first frame that includes a first position and a second position that is different from the first position, a main guide shaft that extends in a transverse direction that intersects a transport direction of the medium and is joined to the first frame at the first position, a second frame that is joined to the first frame at the second position, and an urging member that exerts a force on the second frame by urging the idler roller toward the drive roller. In the transport apparatus, the first position is located in an overlapping region between the first frame and the second frame in a height direction that orthogonally intersects the transport direction and the transverse direction.

10 Claims, 5 Drawing Sheets

(56) References Cited

U.S. PATENT DOCUMENTS

| | | | | |
|---|---|---|---|---|
| 8,025,292 | B2 * | 9/2011 | Takeshita | B65H 5/062 271/274 |
| 8,430,480 | B2 * | 4/2013 | Yajima | B41J 19/00 347/37 |
| 2010/0001461 | A1 | 1/2010 | Takeshita | |

FOREIGN PATENT DOCUMENTS

| | | | |
|---|---|---|---|
| JP | 2001-341884 | A | 12/2001 |
| JP | 2010-013222 | A | 1/2010 |
| JP | 2012-091394 | A | 5/2012 |

* cited by examiner

TRANSPORT APPARATUS AND PRINTING APPARATUS

BACKGROUND

1. Technical Field

The present invention relates to a transport apparatus that transports a medium and to a printing apparatus equipped with the transport apparatus.

2. Related Art

As an example of a printing apparatus, an ink jet type printer that performs printing on a sheet of paper (medium) by ejecting ink is known. Such a printer may be equipped with a transport apparatus that includes, for example, a paper-feed drive roller (second roller), a paper-feed idler roller (first roller), and a coil spring (urging member) (for example, JP-A-2001-341884).

The coil spring is supported by a main frame that is disposed so as to extend in a vertical direction. One end of the coil spring urges the paper-feed idler roller toward the paper-feed drive roller, and the other end exerts a force on the main frame in a substantially vertical direction.

The coil spring is disposed so as to increase a force acting on the main frame in the vertical direction and decrease a force acting horizontally, thereby suppressing warping of the main frame. However, when the main frame is made thinner or smaller so as to, for example, reduce the size of a printer, the force exerted by the other end of the coil spring causes the main frame to warp, which may negatively affect sheet transport.

This problem is not limited to the printer including the coil spring for urging the paper-feed idler roller. The problem is generally common to transport apparatuses that include an urging member urging the first roller and printing apparatuses that include such a transport apparatus.

SUMMARY

An advantage of some aspects of the invention is that a transport apparatus of which the size can be reduced while suppressing warping of a frame and a printing apparatus equipped with the transport apparatus are provided.

A transport apparatus according to a first aspect of the invention includes a first roller and a second roller that transport a medium by rotating with the medium being nipped therebetween, a first frame that includes a first position and a second position that is different from the first position, a predetermined member that extends in a transverse direction that intersects a transport direction of the medium and is joined to the first frame at the first position, a second frame that is joined to the first frame at the second position, and an urging member that exerts a force on the second frame by urging the first roller toward the second roller. In the transport apparatus, the first position is located in an overlapping region between the first frame and the second frame in a height direction that orthogonally intersects the transport direction and the transverse direction.

With this configuration, the transport apparatus includes the first frame and the second frame as separate components. Accordingly, for example, even if the thickness of the first frame is reduced, the second frame can provide rigidity sufficient to oppose the force exerted from the urging member provided that the thickness of the second frame is not reduced. In addition, the first position is located in the overlapping region between the first frame and the second frame in the height direction. As a result, the size of the first frame in the height direction can be reduced compared with a case in which the first position is located in a region in which the first frame and the second frame does not overlap each other. Thus, the size of the transport apparatus can be reduced while suppressing warping of the first frame.

In the transport apparatus, it is preferable that the thickness of the second frame be larger than the thickness of the first frame. According to this configuration, the second frame is thicker than the first frame. The rigidity of the second frame that receives a force from the urging member can be thereby increased.

In the transport apparatus, it is preferable that the second frame be bent toward a region in the transport direction. According to this configuration, the second frame is bent. Thus, the rigidity of the second frame can be thereby increased compared with a case of the second frame not being bent.

In the transport apparatus, it is preferable that the second frame have an engaging portion that is joined to the first frame at the second position, a main body that receives a force from the urging member, and a connection portion that connects the engaging portion and the main body to each other. It is also preferable that the length of the connection portion in the transverse direction be shorter than the length of the engaging portion in the transverse direction.

With this configuration, in the second frame, the rigidity of the connection portion can be reduced relative to the engaging portion. This reduces the likelihood of the first frame deforming in association with deformation of the second frame. It is preferable that the transport apparatus further include a third frame that is joined to the first frame and the third frame hook the urging member.

According to this configuration, the transport apparatus includes the third frame that hooks the urging member, and the third frame is joined to the first frame. This reduces the likelihood of the first frame deforming compared with, for example, a case in which the first frame hooks the urging member.

A printing apparatus according to a second aspect of the invention includes the transport apparatus according to the first aspect of the invention, a printing section that moves in the transverse direction and performs printing on the medium, and the predetermined member. In the printing apparatus, the predetermined member is a guide shaft that guides the printing section in the transverse direction.

With this configuration, the printing apparatus can provide advantageous effects similar to the transport apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a printing apparatus equipped with a transport apparatus will be described with reference to the drawings. The printing apparatus according to the present embodiment is, for example, an ink jet type printer that performs printing (recording) on a medium, such as a sheet of paper, by ejecting ink, which is an example of a liquid.

Figure 1:
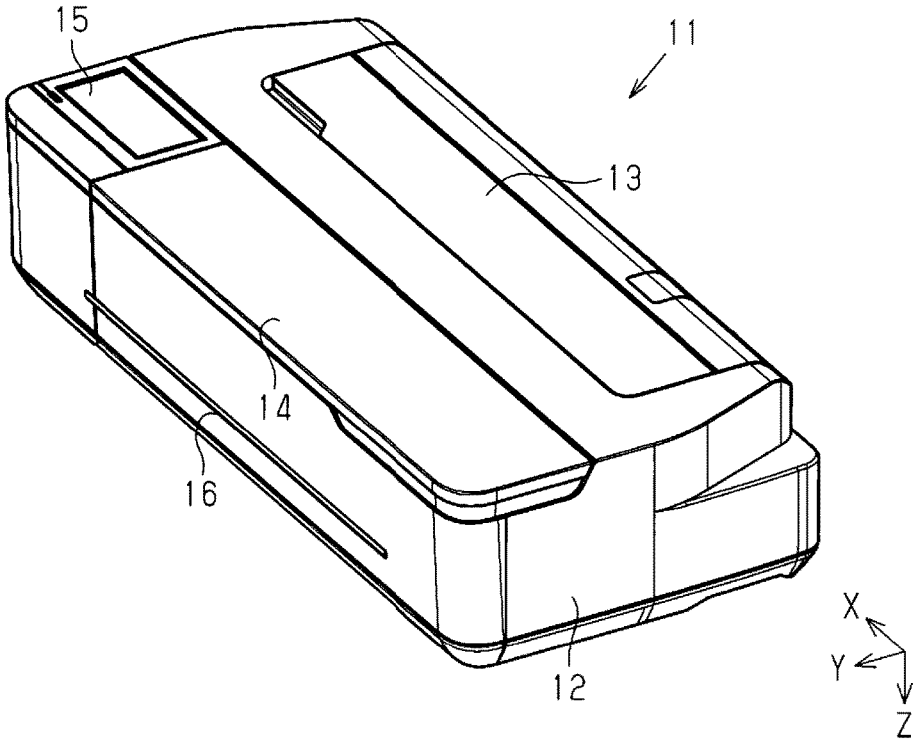
FIG. 1 is a perspective view illustrating one embodiment of a printing apparatus according to the invention.

As illustrated in FIG. 1, a printing apparatus 11 includes a housing 12 that has a predetermined height, depth, and width when the printing apparatus 11 is installed at a location for use. In the embodiment, the width direction and the depth direction are substantially horizontal, and the height direction is represented by the Z-axis as the gravity direction, assuming that the printing apparatus 11 is placed on a horizontal surface. The Y-axis represents a frontward direction from the rear to the front of the apparatus in the depth direction. The X-axis, which intersects the Y-axis and the Z-axis, represents the width direction (transverse direction). Thus, the X-axis, the Y-axis, and the Z-axis are coordinate axes representing width, depth, and height, respectively. The transverse direction, the height direction, and the depth direction are directions different from each other.

On the top face of the housing 12, a first lid 13, which is located in a rear portion, and a second lid 14, which is located in a front portion, are disposed so as to be openable/closable. An operation unit 15 for executing various operations of the printing apparatus 11 is disposed at a position next to the second lid 14 in the transverse direction on the top face of the housing 12. A discharge opening 16 for discharging a medium M (see FIG. 2) on which printing has been performed is formed on the front face of the housing 12.

Figure 2:
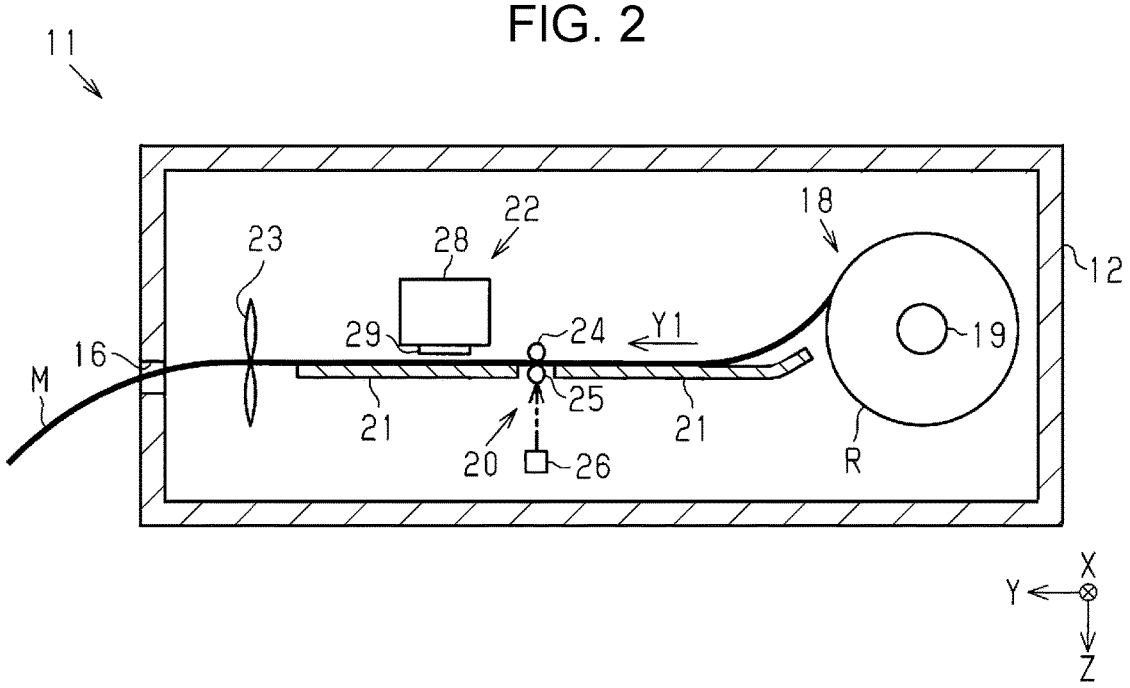
FIG. 2 is a cross-sectional side view schematically illustrating an internal structure of the printing apparatus.

As illustrated in FIG. 2, a roll-mounting section 18 and a feed section 19 are disposed inside the housing 12. A cylindrically shaped roll R around which a medium M is wound is set in the roll-mounting section, and the feed section 19 feeds the medium M from the roll-mounting section 18. The feed section 19 rotatably supports the roll R and unwinds and feeds the medium M by rotating the roll R in one direction (counterclockwise in FIG. 2).

The printing apparatus 11 includes a transport apparatus 20 for transporting a medium M, a support platform 21 for supporting the transported medium M, a printing section 22 for performing printing on the medium M, and a cutting section 23 for cutting the medium M on which printing has been performed.

The transport apparatus 20 includes an idler roller 24, which is an example of a first roller, a drive roller 25, which is an example of a second roller, and a drive source 26 that rotatably drives the drive roller 25. The idler roller 24 and the drive roller 25 transports the medium M by rotating simultaneously while a medium M is nipped therebetween. The transport direction Y1 of the medium M is a direction in which the roll-mounting section 18 is located upstream and the discharge opening 16 is located downstream. The transport direction Y1 is different from (preferably orthogonally intersects) the transverse direction. The transport direction Y1 according to the embodiment is also different from the height direction.

The printing section 22 includes a carriage 28 that is movable in the transverse direction and an ejection head 29 that is supported by the carriage 28. The ejection head 29 has a plurality of nozzles (not shown) that eject liquid such as ink. The printing section 22 performs printing on the medium M while the carriage 28 moves in the transverse direction and the ejection head 29 ejects liquid.

Figure 3:
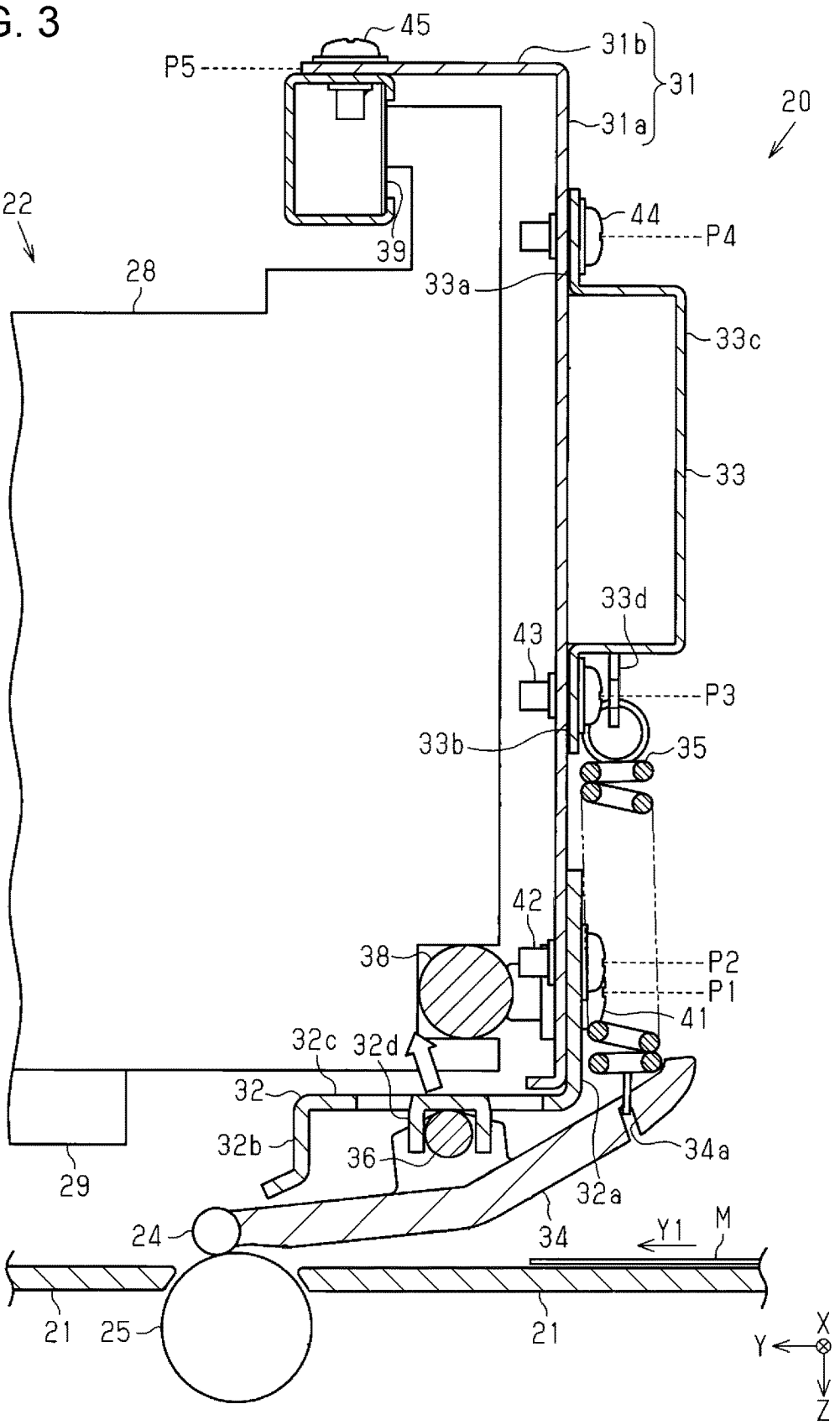
FIG. 3 is a cross-sectional view schematically illustrating part of a transport apparatus.

As illustrated in FIG. 3, the transport apparatus 20 includes a tabular first frame 31, a second frame 32, and a third frame 33. The transport apparatus 20 further includes a retaining unit 34 that retains the idler roller 24 and an urging member 35 that urges the retaining unit 34. The first frame 31, the second frame 32, and the third frame 33 according to the embodiment are formed by subjecting metal sheets having different thicknesses to bending, punching, and the like. The second frame 32 is thicker than the first frame 31, and the first frame 31 is thicker than the third frame 33.

The first frame 31 has a side portion 31*a* that extends in the height and the transverse directions and a top portion 31*b* that extends in the depth and the transverse directions. The top portion 31*b* is formed by bending a top part of the side portion 31*a* toward downstream (toward the front of the apparatus) in the transport direction Y1.

The second frame 32 has a front portion 32*b* and a rear portion 32*a* both of which extend in the height and the transverse directions and a bottom portion 32*c* that extends in the depth and the transverse directions. A shaft support portion 32*d*, which supports a shaft 36 that is included in the retaining unit 34, is formed on the bottom portion 32*c*.

The rear portion 32*a* is formed by bending upward an upstream part in the transport direction Y1 (i.e., a rear part) of the bottom portion 32*c*. The front portion 32*b* is formed by bending downward a downstream part in the transport direction Y1 of the bottom portion 32*c* so as to make the downstream part closer to the transport path of the medium M. In other words, the second frame 32 is formed by bending the rear portion 32*a* and the front portion 32*b* in the depth direction with respect to the bottom portion 32*c*. In other words, the second frame 32 is bent in a direction that is different from the transverse direction (toward a region in the transport direction) so that fold lines are formed in the transverse direction.

The third frame 33 includes an upper portion 33*a*, a lower portion 33*b*, and a middle portion 33*c*, all of which extend in the height and the transverse directions. The third frame 33 further includes a hook portion 33*d* that hooks an urging member 35. A portion between the upper portion 33*a* and the middle portion 33*c* and a portion between the middle portion 33*c* and the lower portion 33*b* are bent like cranks so that the upper portion 33*a* and the lower portion 33*b* are positioned in front of the middle portion 33*c*. The hook portion 33*d* is formed at a position between the middle portion 33*c* and the lower portion 33*b*.

The retaining unit 34 is disposed so as to be able to swing about the shaft 36. The retaining unit 34 retains the idler roller 24 at a position downstream of the shaft 36 in the transport direction Y1. The retaining unit 34 also has a latch portion 34*a* that can hook the urging member 35 at a position upstream of the shaft 36 in the transport direction Y1. The urging member 35 is a tension spring that urges the retaining unit 34 upward. The idler roller 24 is positioned below the level of the shaft 36 in the state in which the retaining unit 34 is urged by the urging member 35.

The retaining unit 34 acts as a lever with the shaft 36 as the fulcrum and pushes the idler roller 24 against the drive roller 25. Thus, the urging member 35 urges the idler roller 24 toward the drive roller 25, thereby exerting a force on the second frame 32 (i.e., exerting a force so as to warp the second frame 32). More specifically, the shaft support portion 32*d* receives a force in a direction indicated by the hollow arrow in FIG. 3, which is opposite to the direction of the idler roller 24 urging the drive roller 25.

The side portion 31*a* of the first frame 31 and the middle portion 33*c* of the third frame 33 are longer than the rear portion 32*a* of the second frame 32 in the height direction. Similarly, the rear portion 32*a* of the second frame 32 is longer than any of the upper portion 33*a* and the lower portion 33*b* of the third frame 33 in the height direction.

The printing apparatus 11 includes a main guide shaft 38 and a secondary guide shaft 39 both of which support the carriage 28 such that the carriage 28 can move in the transverse direction. The main guide shaft 38 and the secondary guide shaft 39 are disposed so as to extend in the transverse direction.

The main guide shaft 38 according to the embodiment is a guide shaft that serves as a predetermined member that guides the carriage 28 in the transverse direction. The guide shaft 38 is joined to the first frame 31. The secondary guide shaft 39 is disposed at a position above the level of the main guide shaft 38. The carriage 28 is mounted on the main guide shaft 38, which is shaped like a round bar, from in front of the main guide shaft 38. The carriage 28 slidably engages the main guide shaft 38. Simultaneously, the carriage 28 is brought into contact with the secondary guide shaft 39, which is shaped like a board, from behind the secondary guide shaft 39 so that the carriage 28 can slide on the secondary guide shaft 39. The main guide shaft 38 and the secondary guide shaft 39 are disposed so as to have a distance therebetween in the height direction. This arrangement suppresses inclination of the carriage 28 in a direction intersecting the height direction (for example, forward tilting).

The transport apparatus 20 includes first screws 41, second screws 42, third screws 43, fourth screws 44, and fifth screws 45. These screws couple the second frame 32, the third frame 33, the main guide shaft 38, and the secondary guide shaft 39 to the first frame 31. The first screws 41 couple the side portion 31*a* of the first frame 31 and the main guide shaft 38 to each other. The positions at which the first screws 41 are mounted on the first frame 31 are referred to as first positions P1 for coupling of the main guide shaft 38.

The second screws 42 couple the side portion 31*a* of the first frame 31 and the rear portion 32*a* of the second frame 32 to each other. The positions at which the second screws 42 are mounted on the first frame 31 are referred to as second positions P2 for coupling of the second frame 32.

The third screws 43 couple the side portion 31*a* of the first frame 31 and the lower portion 33*b* of the third frame 33 to each other. The fourth screws 44 couple the side portion 31*a* of the first frame 31 and the upper portion 33*a* of the third frame 33 to each other. The positions at which the third screws 43 and the fourth screws 44 are mounted are referred to as third positions P3 and fourth positions P4, respectively. The third positions P3 and the fourth positions P4 are positions for coupling the third frame 33 to the first frame 31.

The fifth screws 45 couple the top portion 31*b* of the first frame 31 and the secondary guide shaft 39 to each other. The positions at which the fifth screws 45 are mounted on the first frame 31 are referred to as the fifth positions P5 for coupling of the secondary guide shaft 39.

Positions of screw holes that are formed in the first frame 31 are the positions on which the first screws 41, the second screws 42, the third screws 43, the fourth screws 44, and the fifth screws 45 are mounted. The first screws 41, the second screws 42, the third screws 43, the fourth screws 44, and the fifth screws 45 are provided in respective rows in the transverse direction. More specifically, a plurality of the first screws 41 are provided at a spacing in the transverse direction at the same height. The same applies to the second screws 42, the third screws 43, the fourth screws 44, and the fifth screws 45, which are provided at a spacing in the transverse direction at the same height, respectively.

The first positions P1, the second positions P2, the third positions P3, the fourth positions P4, and the fifth positions P5 are different in height. More specifically, the first positions P1, the second positions P2, the third positions P3, the fourth positions P4, and the fifth positions P5 are provided in this order from the lowest position in the height direction, which is near the transport path of a medium The second frame 32 is joined to the first frame 31 at the second positions P2, which are different from the first positions P1. The third frame 33 is joined to the first frame 31 at the third positions P3 and the fourth positions P4, which are different from the first positions P1 or the second positions P2.

In the height direction, the first positions P1 and the second positions P2 are located in an overlapping region between the first frame 31 and the second frame 32. In other words, the main guide shaft 38 is joined to the first frame 31 in the region that is reinforced by the second frame 32. The overlapping region between the first frame 31 and the second frame 32 is a region located between the bottom end of the first frame 31 and the top end of the second frame 32 in the height direction.

Figure 4:
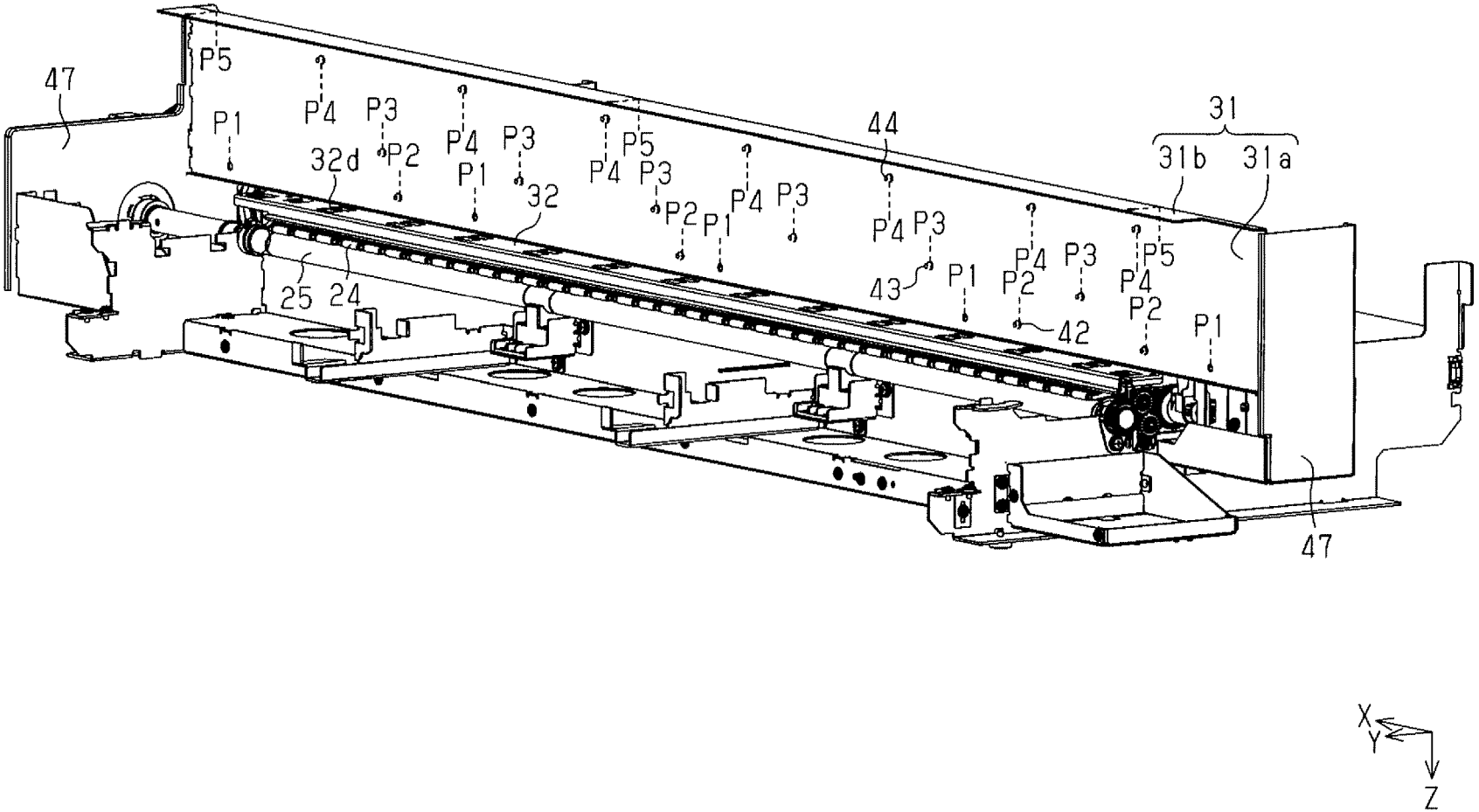
FIG. 4 is a perspective view illustrating the transport apparatus.

As illustrated in FIG. 4, the printing apparatus 11 includes a pair of side frames 47 that are disposed away from each other in the transverse direction. The side frames 47 support corresponding opposite ends of the first frame 31 in the transverse direction.

Figure 5:
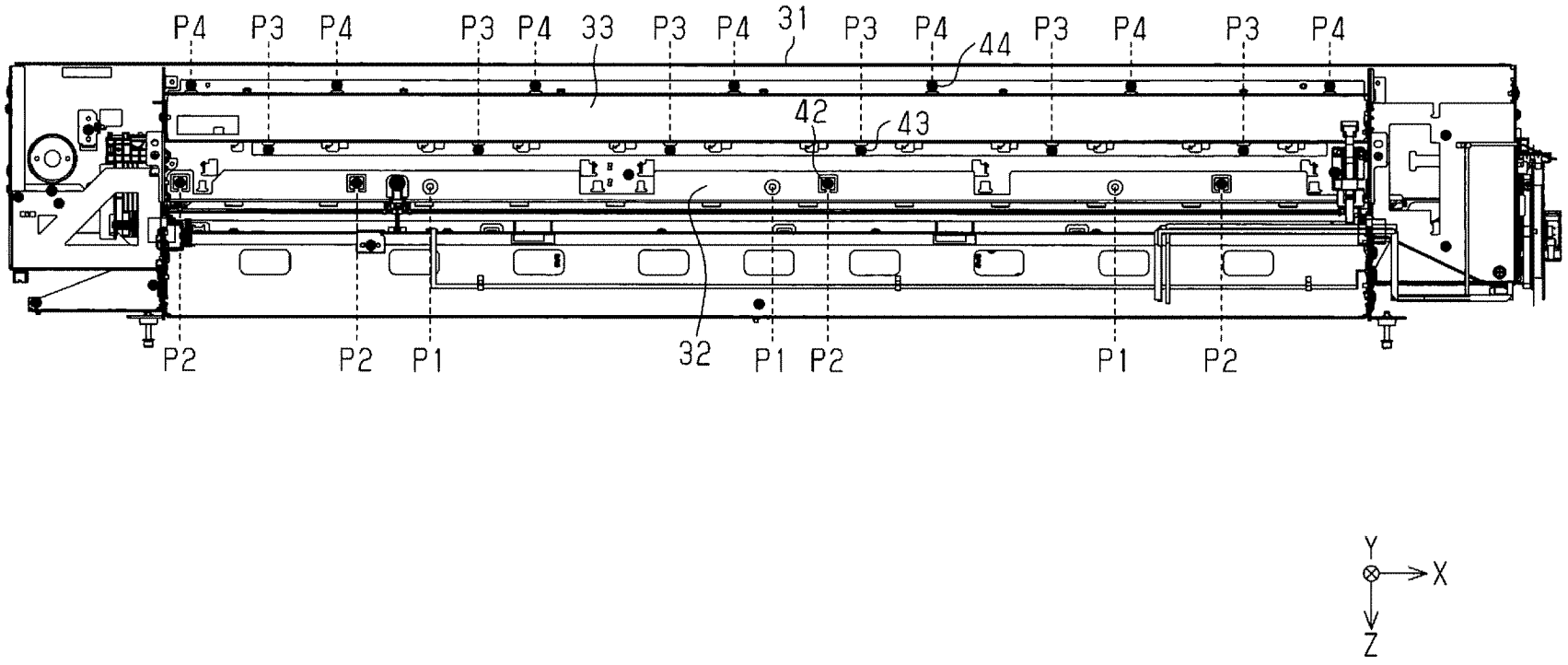
FIG. 5 is a rear view illustrating the transport apparatus.

As illustrated in FIG. 4 and FIG. 5, the first positions P1, the second positions P2, the third positions P3, the fourth positions P4, and the fifth positions P5 are provided at different respective positions in the transverse direction. Accordingly, the second frame 32, the third frame 33, the main guide shaft 38, and the secondary guide shaft 39 are separately fixed to the first frame 31.

Figure 6:
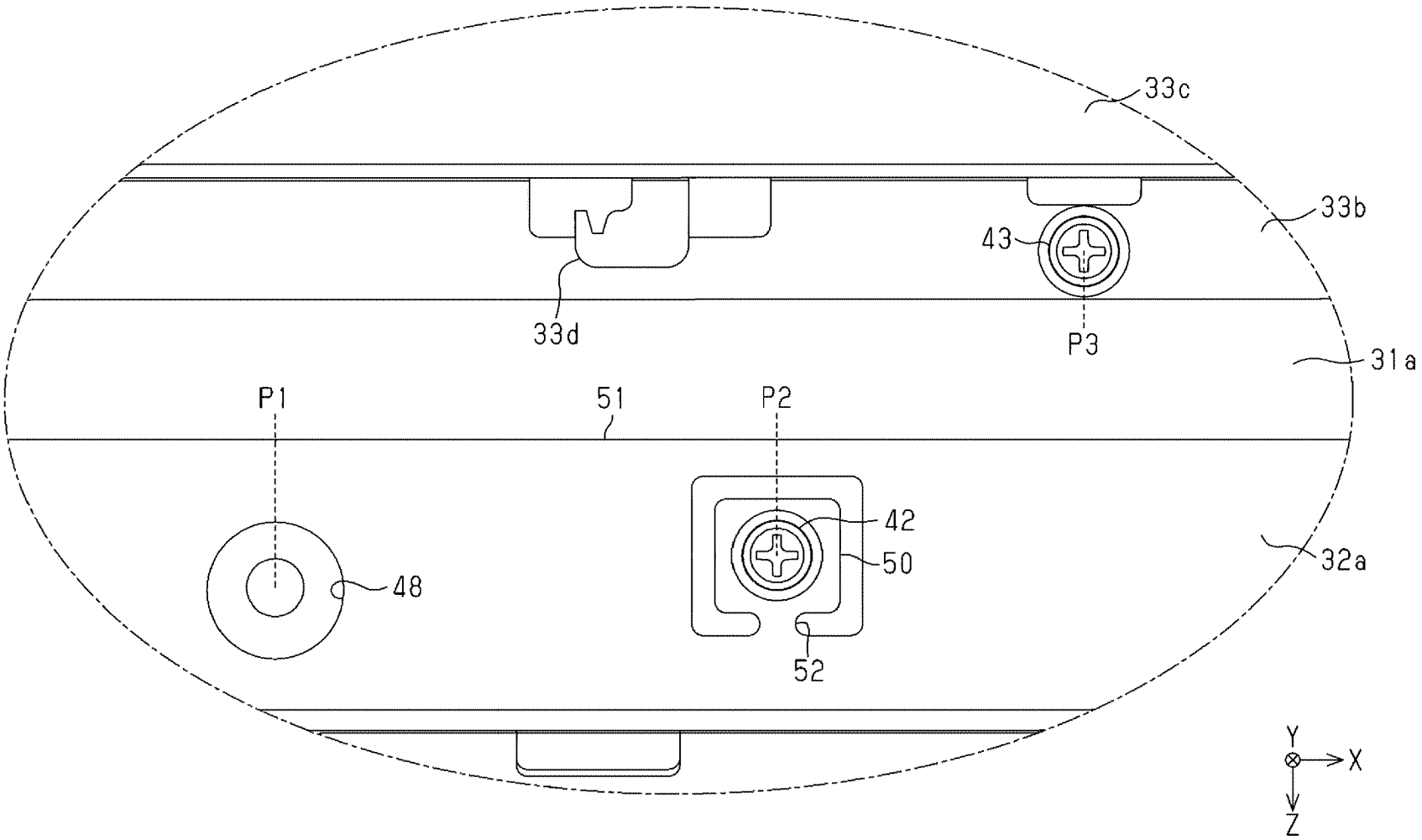
FIG. 6 is an enlarged view illustrating part of the transport apparatus in FIG. 5.

As illustrated in FIG. 6, in the second frame 32, a hole 48 is formed at a first position P1. The hole 48 is larger than the head of a first screw 41. By providing the hole 48, the first screw 41 can couple the first frame 31 and the main guide shaft 38 to each other in the overlapping region between the first frame 31 and the second frame 32 without interference of the second frame 32.

The second frame 32 is constituted by an engaging portion 50 at which a second position P2 is located and that is joined to the first frame 31, a main body 51 that receives a force from the urging member 35, and a connection portion 52 that connects the engaging portion 50 and the main body 51 to each other. The main body 51 includes the rear portion 32*a*, the front portion 32*b*, the bottom portion 32*c*, and the shaft support portion 32*d*. The main body 51 supports the retaining unit 34 and thereby receives the urging force from an urging member 35.

The length of the connection portion 52 in the transverse direction is shorter than that of the engaging portion 50, and the connection portion 52 is shaped like a neck with respect to the engaging portion 50. Accordingly, the rigidity of the connection portion 52 is smaller than that of the engaging portion 50. The engaging portion 50 and the connection portion 52 are formed by punching out a portion of the main body 51 and thereby surrounded and protected by the main body 51.

Next, operation of the printing apparatus 11 will be described by focusing on the transport apparatus 20 transporting a medium M. As illustrated in FIG. 2 and FIG. 3, the feed section 19 sends a medium M between the rotating drive roller 25 and the idler roller 24. The transport apparatus 20 urges the idler roller 24 toward the drive roller 25 while the medium M is nipped between the drive roller 25 and the idler roller 24. As a result, a frictional force acts between the medium M and the drive roller 25 to a degree sufficient to transport the medium M. The transport apparatus 20 transports the medium M by transmitting the rotational force of the drive roller 25 to the medium M. The carriage 28, which is guided by the main guide shaft 38 and the secondary guide shaft 39, moves in the transverse direction and performs printing on the medium M transported by the transport apparatus 20.

With the present embodiment, the following advantageous effects can be obtained. The transport apparatus 20 includes the first frame 31 and the second frame 32 as separate components. Accordingly, for example, even if the first frame 31 is made thinner, the second frame 32 can provide rigidity sufficient to oppose the force exerted from the urging member 35 provided that the thickness of the second frame 32 is not reduced. In addition, the first positions P1 are located in the overlapping region between the first frame 31 and the second frame 32 in the height direction. As a result, the size of the first frame 31 in the height direction can be reduced compared with a case in which the first positions P1 are located in a region in which the first frame 31 and the second frame 32 does not overlap each other. Thus, the size of the transport apparatus 20 can be reduced while suppressing warping of the first frame 31.

The second frame 32 is thicker than the first frame 31. The rigidity of the second frame 32 that receives the force from the urging member 35 can be thereby increased. The second frame 32 is bent. The rigidity of the second frame 32 can be thereby increased compared with a case of the second frame 32 not being bent.

In the second frame 32, the length of the connection portion 52 in the transverse direction is made shorter than the length of the engaging portion 50 in the transverse direction. Thus, the rigidity of the connection portion 52 can be thereby reduced. This reduces the likelihood of the first frame 31 deforming in association with deformation of the second frame 32.

The transport apparatus 20 includes the third frame 33 that hooks the urging member 35, and the third frame 33 is joined to the first frame 31. This reduces the likelihood of the first frame 31 deforming compared with a case, for example, in which the first frame 31 hooks the urging member 35.

The first frame 31 and the third frame 33 are thinner than the second frame 32. This can reduce the weight of the transport apparatus 20 compared with a case in which the first frame 31 and the third frame 33 are made as thick as the second frame 32.

The above embodiment may be modified into modification examples described below. The above embodiment and modification examples described below may be combined arbitrarily. The urging member 35 may urge the drive roller 25 that serves as an example of the first roller toward the idler roller 24 that serves as an example of the second roller.

The printing apparatus 11 may be formed without including the secondary guide shaft 39. The third frame 33 may be formed without including the hook portion 33*d*. Moreover, the transport apparatus 20 may be formed without including the third frame 33. For example, the hook portion 33*d* is formed in the first frame 31 or in the second frame 32 so that the first frame 31 or the second frame 32 may hook the urging member 35. The third frame 33 need not be joined to the first frame 31.

The second frame 32 need not be constituted by the engaging portion 50, the main body 51, and the connection portion 52. For example, screw holes may be formed directly in a tabularly shaped second frame. The connection portion 52 may be formed in an arbitrary shape provided that the rigidity of the connection portion 52 is smaller than those of the engaging portion 50 and the main body 51. For example, the connecting portion 52 may have a recess on one side thereof in the transverse direction. The connection portion may be formed by providing a hole between the engaging portion 50 and the main body 51. The rigidity of the connection portion 52 may be reduced by making the connection portion 52 thinner than the engaging portion 50 or the main body 51.

The engaging portion 50 need not be surrounded by the main body 51. For example, the engaging portion 50 and the connection portion 52 may be formed so as to protrude upward from the top end of the second frame 32. The second frame 32 need not be bent. The second frame 32 may be bent in the transverse direction. For example, the second frame 32 may be formed as a corrugated sheet with fold lines extending in the transport direction Y1.

At least two of the first frame 31, the second frame 32, and the third frame 33 may have the same thickness. The transport apparatus 20 may be disposed in an apparatus different from the printing apparatus 11. For example, the transport apparatus 20 may be applied to a scanner in which an image sensor for reading an image from a medium M is mounted on a carriage that can move in the transverse direction. In the case of the scanner, a guide shaft that guides the carriage may serve as the predetermined member, and a frame that supports the guide shaft may serve as the first frame.

The idler roller 24, the first frame 31, the second frame 32, and the third frame 33 may be disposed below the level of the drive roller 25 in the gravity direction. For example, the image sensor may read an image from beneath a medium M.

A liquid may be selected arbitrarily provided that the liquid adheres to the medium M so as to enable printing on a medium M. Note that "liquid" as used herein may be referred to as a material that is in a liquid phase, which includes a fluid-state material such as a high viscosity or low viscosity liquid-state material, a sol, gel water, an inorganic solvent, an organic solvent, a solution, a liquid resin, a liquid metal (metallic melt). In addition to liquid-state materials, the term "liquid" encompasses a material made by dispersing, mixing, or solving the particles of a functioning material consisting of solids, such as pigments or metal particles, in a solvent. A typical example of a liquid is ink. The term "ink" encompasses typical water-based or oil-based inks and various liquid composites, such as a gel ink and a hot melt ink.

The medium M may be a sheet of paper, a resin film, a resin sheet, a composite film of paper and resin (resin-impregnated paper, resin-coated paper, etc.), a metallic foil, a metallic film, a woven material, a nonwoven material or the like.

The printing apparatus 11 is an apparatus that prints characters and images, such as pictures and photographs, by causing liquid such as ink or fluid such as toner to adhere to a medium, which may include a serial printer, a lateral printer, a line printer, a page printer or the like. The printing apparatus 11 may also be an offset-printing machine, a cloth-printing machine, or the like. Moreover, it is sufficient that the printing apparatus 11 has at least a function of printing on a medium. Thus, the printing apparatus 11 may be a multifunction copier that has other functions in addition to the printing. In the case of a printing apparatus in which the printing section 22 does not move, a support member that supports the printing section 22 serves as the predetermined member that extends in the transverse direction.

This application claims priority under 35 U.S.C. § 119 to Japanese Patent Application No. 2017-104641, filed May 26, 2017. The entire disclosure of Japanese Patent Application No. 2017-104641 is hereby incorporated herein by reference.

What is claimed is:

1. A transport apparatus, comprising:

a first roller and a second roller that transport a medium by rotating with the medium being nipped therebetween;

a first frame that includes a first position and a second position that is different from the first position;

a predetermined member that extends in a transverse direction that intersects a transport direction of the medium and is joined to the first frame at the first position;

a second frame that is joined to the first frame at the second position; and an urging member that exerts a force on the second frame by urging the first roller toward the second roller, wherein the first position is located in an overlapping region between the first frame and the second frame in a height direction that orthogonally intersects the transport direction and the transverse direction.

2. The transport apparatus according to claim 1, wherein the thickness of the second frame is larger than the thickness of the first frame.

3. The transport apparatus according to claim 1, wherein the second frame is bent toward a region in the transport direction.

4. The transport apparatus according to claim 1, wherein the second frame has an engaging portion that is joined to the first frame at the second position, a main body that receives a force from the urging member, and a connection portion that connects the engaging portion and the main body to each other, and the length of the connection portion in the transverse direction is shorter than the length of the engaging portion in the transverse direction.

5. The transport apparatus according to claim 1, further comprising a third frame that is joined to the first frame, wherein the third frame hooks the urging member.

6. A printing apparatus, comprising:

the transport apparatus according to claim 1;

a printing section that moves in the transverse direction and performs printing on the medium; and the predetermined member, wherein the predetermined member is a guide shaft that guides the printing section in the transverse direction.

7. A printing apparatus, comprising:

the transport apparatus according to claim 2;

a printing section that moves in the transverse direction and performs printing on the medium; and the predetermined member, wherein the predetermined member is a guide shaft that guides the printing section in the transverse direction.

8. A printing apparatus, comprising:

the transport apparatus according to claim 3;

a printing section that moves in the transverse direction and performs printing on the medium; and the predetermined member, wherein the predetermined member is a guide shaft that guides the printing section in the transverse direction.

9. A printing apparatus, comprising:

the transport apparatus according to claim 4;

a printing section that moves in the transverse direction and performs printing on the medium; and the predetermined member, wherein the predetermined member is a guide shaft that guides the printing section in the transverse direction.

10. A printing apparatus, comprising:

the transport apparatus according to claim 5;

a printing section that moves in the transverse direction and performs printing on the medium; and the predetermined member, wherein the predetermined member is a guide shaft that guides the printing section in the transverse direction.

* * * * *